United States Patent [19]

Hirase et al.

[11] Patent Number: 4,886,444

[45] Date of Patent: Dec. 12, 1989

[54] PROCESS FOR TREATING GASEOUS EFFLUENTS COMING FROM THE MANUFACTURE OF ELECTRONIC COMPONENTS AND INCINERATION APPARATUS FOR CARRYING OUT SAID PROCESS

[75] Inventors: Ikuo Hirase, Ibaraki, Japan; Denis Rufin, Hinsdale, Ill.

[73] Assignee: L'Air Liquide, Paris, France

[21] Appl. No.: 217,457

[22] Filed: Jul. 11, 1988

[30] Foreign Application Priority Data

Jun. 19, 1987 [FR] France ..... 87 08667

[51] Int. Cl.[4] ..... F23D 14/00; F23G 7/08; F23J 15/00

[52] U.S. Cl. ..... 431/5; 110/213; 422/168; 431/202

[58] Field of Search ..... 431/5, 202; 110/237, 110/213; 422/168, 182; 423/210

[56] References Cited

U.S. PATENT DOCUMENTS 4,052,266 10/1977 Griffith ..... 431/5 X
4,087,235 5/1978 Ito et al. ..... 431/174
4,152,399 5/1979 Gernierdonk et al. ..... 431/5 X
4,216,060 8/1980 Murata et al. ..... 110/345 X

FOREIGN PATENT DOCUMENTS 0021321 6/1980 European Pat. Off. .
0160524 11/1985 European Pat. Off. .
1277209 3/1966 Fed. Rep. of Germany .
3338888 10/1983 Fed. Rep. of Germany .
1415062 9/1965 France .
1603910 6/1971 France .

*Primary Examiner*—Edward G. Favors
*Attorney, Agent, or Firm*—Lee C. Robinson, Jr.

[57] ABSTRACT

A process and apparatus for treating waste products coming from the manufacture of electronic components. The effluent gases are aspirated by an inert vehicle gas, then intimately mixed with a preheated oxidizing gas, then remain in contact therewith at a sufficient temperature and for a sufficient period of time for the incineration, then the products of oxidation are cooled by thermal exchange to condensation, and the solid products of oxidation are collected and the residual gases washed, and there is realized a cascade of pressure drops along the gaseous current.

12 Claims, 1 Drawing Sheet

Figure 1:
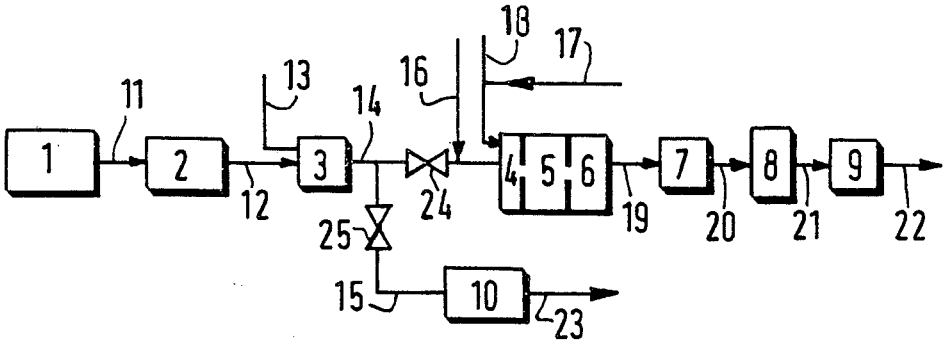

PROCESS FOR TREATING GASEOUS EFFLUENTS COMING FROM THE MANUFACTURE OF ELECTRONIC COMPONENTS AND INCINERATION APPARATUS FOR CARRYING OUT SAID PROCESS

The present invention relates to a process for incinerating gaseous effluents comprising in particular inorganic hydrides and an apparatus for treating said effluents.

In the field of the manufacture of integrated circuits and electronic components, in particular by the technique of chemical vapour phase deposition (CVD), it is essential, for protecting against pollution and fire, to avoid rejecting to the atmosphere the used gases and/or the gases generated by these techniques. Indeed, certain gaseous compounds emitted, which are present in the gaseous effluents, are toxic for man and/or combustible in contact with air at high temperature or spontaneously combustible and burnt in contact with air or any oxidizing agent, even at ambient temperature.

The effluents to be treated include not ony the metallization gases but also the compounds derived or generated by the deposition reactions or parasite reactions, and also the products resulting from reactions between gases and materials in contact (example: pump oil).

It may concern metallic hydrides, metal cabonyl compounds, and possibly inorganic halogenated compounds, organic or gaseous and combustible compounds.

Thus, the gaseous effluents to be treated are in particular combustible gaseous inorganic hydrides, such as silicon hydrides, in particular $SiH_4$, $Si_2H_6$, $Si_3H_8$, and halogenosilanes of the type $SiH_xCl_{4-x}$of arsenic, in particular arsine $AsH_3$, of phosphorus, in particular $PH_3$, of boron, in particular $B_2H_6$, of germanium, in particular $GeH_3$, and other metals such as molybdenum, used in the manufacture of compounds or contained in the manufacturing material.

Among the carbonyl metals, and the inorganic halogenated compounds, there may be mentioned $W(CO)_6$, $Mo(CO)_6$ and the fluorides, and iodides of silicon, titanium, tungsten, molybdenum and tantalum.

There may also be mentioned in the rejects after the pumps, the organo- and/or halogenosilanes, the hydrogen halides, the gases including nitrogen (derived from etching gases) and the organic compounds coming from the pumps.

A conventional method for purifying the gaseous effluents to eliminate their toxic and/or dangerous components comprises aspirating the gaseous effluents out of the CVC system by means of one or more pumps, such as vacuum pumps, and then passing these gaseous effluents into one or more absorption towers or columns where the gaseous effluents are put in contact with a solid or liquid absorbant or adsorbant agent. All or part of the harmful gaseous components are thus absorbed or adsorbed and the gaseous effluents are then treated by bubbling or some other absorption treatment, depending on the nature of the residual components to be eliminated.

However, according to this conventional method, the absorbant agents employed may be rapidly contaminated and/or exhausted, so that frequent replacements of the absorbing agent are required to guarantee a reasonable degree of effectiveness of the purification. Further, the absorbing agents employed for this use are often expensive and cannot be regenerated, and the required replacements are hardly compatible with continuous industrial processes.

Another method comprising burning the effluents as they leave the system is dangerous inasmuch as it is difficult to accept with a fluctuating level of emission of the combustible effluents: when the emission stops, the combustion stops and the resumption of the emission, if combustion is not maintained, results in an accumulation of an inflammable gas and a risk of explosion which is capable of being propagated to the CVD system.

Even if care is taken to maintain the combustion, the latter achieved directly at the exit of the system in the air or with some comburent gas, presents definite dangers of flame return or simply the introduction of the oxidizing agent on the upstream side of the burner upon drops in the emission pressures and therefore risk of explosion.

The present invention relates to a process for treating gaseous effluents defined above, characterized in that the effluent gases are aspirated by an inert vehicle gas, then intimately mixed with a preheated oxidizing gas, then remain in contact therewith at sufficient temperature and a sufficient period of time for the incineration, then the oxidation products are cooled by thermal exchange until condensation is achieved, and the solid oxidation products are collected and the residual gases scrubbed, and a cascade of pressure drops is realized along the gaseous current.

The compounds which had been subjected to the incineration according to the invention, i.e. which sejourned a sufficiently long period, depending on the temperature, to be oxydized in the incineration chamber, are then cooled in an exchanger having cold walls and condensed in the form of oxides.

The oxides of silicon (silica) and principally metals are in the form of solid particles and may be separated from the residual gases by any mechanical separating means, for example filtration and/or centrifugation.

The residual gases are scrubbed in a preferably alkaline solution to trap the acids and are then rejected to the atmosphere.

A first advantage of the process according to the invention is to render the trapping of the undesirable elements more reliable and easy since the elements are oxidized and in the solid form.

The feature of the invention according to which there is realized a cascade of pressure drops along the gaseous current presents the advantage of eliminating risks of explosion by flame return or by a countercurrent of oxidizing agent.

Thus, a first pressure drop is achieved by an ejector system in which an inert gas "pumps" or "aspirates" by the Venturi effect the effluent gases just at their exit from the CVD system. This pumping system, which is by definition nonmechanical, has the interest of being non-corrodable.

The process involves an incineration and does not require a continuous emission of gas to be treated and can therefore accept with no inconvenience drops in or stoppages of the emission.

The present invention also relates to an apparatus for the incineration of a mixture of gaseous effluents which may comprise inorganic hydrides, inorganic halogen compounds, gaseous and combustible organic compounds, said apparatus comprising at least one air preheating chamber provided with an air inlet, a burner, and a hot air outlet; a chamber for mixing the hot oxidizing gas and the gaseous effluents provided with a hot oxidizing gas inlet, an injection nozzle for the effluents, means for inducing the mixture, and an outlet opening for the mixture; an incineration chamber provided with an inlet for the mixture; a cooling region and a collector for solid matter provided with exhaust means for the effluents from the incineration, means being provided for creating successive depressions in the direction of flow of the gases.

Figure 2:
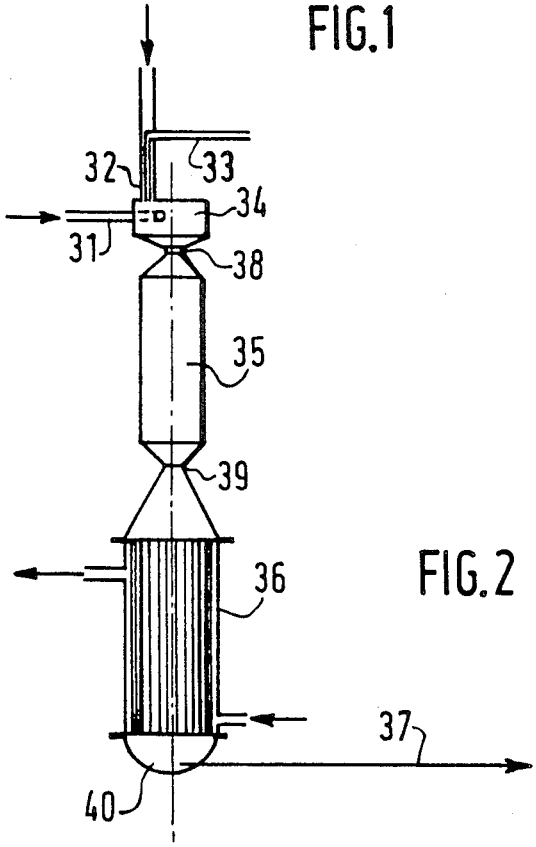

A better understanding of the invention will be had from the following detailed description with reference to the accompanying figures, in which:

FIG. 1 is a diagrammatic representation of an installation for carrying out the process, FIG. 2 is a diagrammatic sectional view of an incineration apparatus according to the invention.

FIG. 1 shows the CVD system 1 whose effluents, which flow through the pipe 11, are pumped by the pump 2 and rejected through the pipe 12 to an ejector 3. The ejector 3 is fed through the pipe 13 with inert gas which is the driving vehicle gas of the ejector whose current entrains the effluents from the CVD system by a venturi effect. The effluents are therefore aspirated by venturi effects and diluted and entrained by the same inert gas vehicle.

The diluted effluents reach through the pipe 14 the premixing chamber 4 where the gaseous current enters, sheathed by an inert gas supplied through the pipe 16. A combustible gas burnt in the burner 17 heats the air current travelling through the pipe 18 before the current enters the premixing chamber 4 where, by a vortex effect, the gases coming from the pipes 14 and 18 are intimately mixed before reaching the incineration chamber 5. The oxidizing gas employed is air, although air doped with oxygen or another oxidizing agent may be employed. The period of sojourn is sufficient to ensure that the combustibles are converted into oxides; in the exchanger 6, the oxides are condensed and received at the outlet through the pipe 19 in a filter 7 where the particles of oxide are retained. The residual gases pass through washing towers in a moist medium or washing flasks 8 and are drawn out of the installation by a fan extractor 9 before being rejected to the atmosphere through the pipe 22.

As a safety measure, valves 24 and 25 in the pipe 14 and pipe 15 enable the current to be bypassed to cartridges 10 of an adsorbant or absorbant medium which effects the purification in the case of a temporary stoppage of the incineration installation 4, 5, 6.

FIG. 2 shows an embodiment of an incineration apparatus according to the invention. The cylindrical premixing chamber 34 is provided, on one hand, with a pipe 31 supplying preheated oxidizing gas, and, on the other hand, with a double flow pipe 32 connected to a source of a sheathing inert gas (not shown) whose internal pipe 33 is connected to the supply of the diluted effluents.

The sheathing achieved prevents the combustible gases from being oxidized upon their injection, which would stop up the injector with the oxides formed.

This pipe 32–33 is parallel to the main axis of the chamber 34 but does not coincide with this axis. The pipe 31 is perpendicular to the axis of the chamber but its direction is such as to avoid intersecting this axis. This arrangement ensures an intimate oxidizing agent-effluent mixture by the vortex effect. A throttling neck 38 separates the chamber 34 from the incineration chamber 35 whose volume is larger than that of the chamber 34. A throttling neck 39 separates the chamber 35 from the cooler 36 having cold walls and cooled with water. In this exchanger having cold walls, the submicronic particles issuing from the incineration chamber become agglomerated while cooling and reach a size of a few microns which makes it easier to capture them in the filters. The collector 40 is provided with a discharge pipe 37 which leads to particle filters, a gas scrubber and extractors (not shown).

EXAMPLE

Applicant has developed an installation such as described hereinbefore and applied it to the incineration of waste issuing from the chemical chest and/or the main pump of a CVD system. The oxidizing gas employed is air.

In the ejector, the driving fluid $N_2$, has a flow rate of 2 to 3 cu Nm/hr, and the pressure is about 1 bar. The venturi created in the injector aspirates the rejects of the CVD system according to the following characteristics:

| PRESSURE DROP (BAR) | −0.1 | 0 | +0.015 |
|---|---|---|---|
| ASPIRATED GASEOUS REJECT FLOW RATES ($Nm^3/hr$) | 0 | 0.5 | 1 |

The sheathing gas and the vortex created in the premixing chamber are also adapted to prevent the solid oxide particles from for example forming and sojourning in this chamber so that stopping up risks are avoided.

The burner produces an air/propane flame which brings the air to be preheated to a temperature of 1200° C. and a maximum temperature of 1400° C. The burner develops a thermal power of 10,000 kcal/hr.

The flow rates of the flame gases are 0.2 to 0.3 cu Nm/hr for the propane and 6 cu Nm/hr for the air, which permit the preheating of 6 cu Nm/hr of air injected tangentially into the chamber which is at a temperature of about 1100° C. and at the most 1200° C.

In the premixing chamber, 2 cu Nm/hr of sheathing nitrogen entrain 1 to 5 cu Nl/min of effluents to be treated with a maximum of 50 cu Nl/min.

In the incineration chamber, the resistance time is about 5 seconds which allows the oxides to be formed, these oxides issuing at a temperature of about 800° C.

The thermal exchanger has inlet and outlet temperatures of about 600° C. and 110° C. (maximum 800° C. and 180° C.) which results in a pressure drop of 5 mm $H_2O$.

As a filter, there are used filters of PTFE known under the name of gortex which are capable of retaining particles of a few fractions of micro-metres. This material resists the operating temperatures (<180° C.) and acids.

The pipes between the cooler and the filter or filters, the filters and the washing flasks are maintained at a temperature higher than 100° C. so as to avoid condensation of the water.

The washing flask or flasks for the residual gases adapted to trap in particular the acids, are provided with a 3% washing soda.

The extractor which provides, downstream of the washing flasks, the depression before the discharge of the residual gases to the atmosphere, has a flow rate of 2 cu.m/min and results in a pressure drop of 500 mm $H_2O$.

Throughout the installation, and in particular in the incineration apparatus, the sealing is afforded by copper or asbestos sealing elements.

The metal parts and walls are of stainless steel of the type 316 L; the insulating material employed, in particular in the premixing and combustion chambers, is a refractory material $Al_2O_3SiO_2$.

The gases treated according to the process and in such an apparatus reach contents which are lower than their allowable maximum concentration recommended in industrial premises. These concentrations permit exposures of 8 hours per day 5 days per week without any detectable effect on the individual.

We claim:

1. A process for continuously treating gaseous effluents of the CVD type by oxidation, wherein the effluent gases are aspirated by an inert vehicle gas, then intimately mixed with a preheated oxidizing gas, then remain in contact therewith at a sufficient temperature and for a sufficient period of time for the incineration, then the oxidizing products are cooled by thermal exchange to condensation, and the solid products of oxidation are collected and the residual gases washed, and there is realized a cascade of pressure drops along the gaseous current.

2. A process according to claim 1, wherein the mixture of effluents and oxidizing gas is achieved by a gaseous vortex.

3. A process according to claim 1 wherein the effluent gases are sheathed by an inert gas.

4. A process according to claim 1 wherein the gaseous effluents are diluted and entrained by a current of vehicle gas before they are mixed with the oxidizing agent.

5. An apparatus for incinerating a mixture of gaseous effluents which may comprise inorganic hydrides, inorganic halogen compounds, gaseous and combustible organic compounds, said apparatus comprising at least one chamber for preheating oxidizing gas provided with an oxidizing gas inlet, a burner, and a hot oxidizing gas outlet; a chamber for mixing hot oxidizing gas and gaseous effluents provided with a hot oxidizing gas inlet, a nozzle for injecting the effluents, means for inducing the mixture, and a mixture outlet opening; an incineration chamber provided with an inlet for the mixture, a region for cooling the products of incineration, and a collector of solid matter provided with exhaust means for the effluents from the incineration, means being provided for creating successive depressions in the direction of flow of the gases.

6. An apparatus according to claim 5, wherein the mixing chamber is provided with means for creating a gaseous vortex.

7. An apparatus according to claim 5 wherein the mixing chamber is cylindrical, the hot oxidizing gas inlet pipe is substantially perpendicular to the injection nozzle for the gaseous effluents, the injection direction of the nozzle being parallel to the axis of the chamber and not coincident therewith and the direction of said pipe does not intersect the axis of the chamber.

8. An apparatus according to claim 5 wherein the injection nozzle is a double coaxial flow nozzle.

9. An apparatus according to claim 5, which further comprises an exchanger having cold walls in the cooling region of the incineration chamber.

10. An apparatus according to claim 5 wherein the means for creating depressions are throttles in particular between the mixing chamber and the incineration chamber and said incineration chamber and the cooling region.

11. A process for treating gaseous effluents by oxidation, comprising the steps of:

aspirating the effluent gases by an inert vehicle gas;

heating an oxidizing gas;

intimately mixing the aspirated effluent gases with the oxidizing gas;

maintaining the aspirated effluent gases and the oxidizing gas in contact at a sufficient temperature and for a sufficient period of time to incinerate the effluent gases;

cooling the resulting oxidizing products;

collecting the solid products of oxidation; and washing the residual gases.

12. Apparatus for incinerating gaseous effluents, the apparatus comprising, in combination:

a first chamber for heating oxidizing gas, the first chamber being provided with an oxidizing gas inlet, heating means and an oxidizing gas outlet;

a second chamber for mixing heated oxidizing gas and gaseous effluents, the second chamber being provided with an oxidizing gas inlet connected to the oxidizing gas outlet of said first chamber, an effluent gas inlet and a mixture outlet;

an incineration chamber for incinerating effluent gas from said second chamber, the incineration chamber being provided with a mixture inlet connected to the mixture outlet of said second chamber;

means for cooling the products of incineration from said incineration chamber; and means for collecting solid matter form said incineration products.

* * * * *